US006963261B2

(12) United States Patent
Vicentelli

(10) Patent No.: US 6,963,261 B2
(45) Date of Patent: Nov. 8, 2005

(54) MAGNETIC ANCHORING MODULE WITH A SYSTEM FOR ENABLING/DISABLING AND ADJUSTING THE MAGNETIC ANCHORING FORCE AND RELATED ASSEMBLIES

(76) Inventor: Claudio Vicentelli, Localita la Scaletta, Alghero (IT) 07041

( * ) Notice: Subject to any disclaimer, the term of this patent is extended or adjusted under 35 U.S.C. 154(b) by 121 days.

(21) Appl. No.: 10/482,023

(22) PCT Filed: Jun. 24, 2002

(86) PCT No.: PCT/EP02/06944

§ 371 (c)(1),
(2), (4) Date: Dec. 29, 2003

(87) PCT Pub. No.: WO03/003388

PCT Pub. Date: Jan. 9, 2003

(65) Prior Publication Data

US 2004/0164830 A1 Aug. 26, 2004

(30) Foreign Application Priority Data

Jun. 29, 2001 (IT) ..... MI2001A1394

(51) Int. Cl.[7] ..... H01F 7/20
(52) U.S. Cl. ..... 335/288; 335/285; 335/295
(58) Field of Search ..... 335/285–288, 335/295; 269/8

(56) References Cited

U.S. PATENT DOCUMENTS

| | | | | |
|---|---|---|---|---|
| 4,251,791 | A | 2/1981 | Yanagisawa et al. | |
| 4,465,993 | A * | 8/1984 | Braillon | 335/287 |
| 4,492,036 | A | 1/1985 | Beckwith, Jr. | |
| 5,345,207 | A * | 9/1994 | Gebele | 335/298 |
| 6,667,678 | B2 * | 12/2003 | Kurosu et al. | 335/220 |
| 6,707,360 | B2 * | 3/2004 | Underwood et al. | 335/288 |

FOREIGN PATENT DOCUMENTS

| | | |
|---|---|---|
| DE | 23 37 887 | 2/1975 |
| GB | 2 121 238 | 12/1983 |
| WO | WO 99/60583 | 11/1999 |
| WO | WO 02/076565 | 10/2002 |

* cited by examiner

*Primary Examiner*—Lincoln Donovan
*Assistant Examiner*—Bernard Rojas
(74) *Attorney, Agent, or Firm*—Young & Thompson

(57) ABSTRACT

Magnetic module for the magnetic anchorage to a ferromagnetic surface of another magnetic, or ferromagnetic module, whose head includes: a first multipolar magnetic stator that in turn defines a multipolar magnetic anchoring surface, and a multipolar magnetic rotor or a second multipolar magnetic stator, coaxial to and facing the first multipolar magnetic stator and equipped with means for orienting the poles of the multipolar magnetic rotor or second multipolar magnetic stator, in series or in parallel with respect to the poles of the first multipolar magnetic stator in order to disable or enable the multipolar magnetic anchoring surface of the first magnetic stator.

30 Claims, 6 Drawing Sheets

MAGNETIC ANCHORING MODULE WITH A SYSTEM FOR ENABLING/DISABLING AND ADJUSTING THE MAGNETIC ANCHORING FORCE AND RELATED ASSEMBLIES

The present invention refers to a magnetic module equipped with a system for enabling the magnetic force for anchoring a further magnetic, or ferromagnetic module to a ferromagnetic surface, for use in the case of the magnetic module developing a magnetic force of attraction comparable with or superior to the limit of human force. The invention refers also to assemblies obtained using these magnetic modules.

The European patent application No. EP9902040, which is the property of the present applicant, describes an assembly resulting from a combination of magnetic modules with other magnetic and/or ferromagnetic modules. The magnetic modules referred to in said application include at least one active magnetic element, i.e. an element that has two polar surfaces of opposite sign, and at least one ferromagnetic element.

One of the fundamental characteristics of the assembly described in the European patent application No. EP9902040 consists in the fact that the magnetic flux generated by the active magnetic elements involved in the anchorage between modules is at least partially short-circuited through the modules' ferromagnetic elements, and in the fact that the differences in magnetic potential produced by the active magnetic elements involved in the anchorage between modules are added together in series.

Such an anchoring system enables a high ratio to be achieved between the anchoring force between the modules in the assembly and the weight of the assembly as a whole, thus enabling the construction of even highly-complex self-supporting lattice structures, e.g. scaffolding for theatre stage scenery, or advertising panels.

When the forces of magnetic attraction between the modules exceed a threshold of 2–3 kg, it becomes advisable—given the limit of human force, to facilitate assembly and dismantling, and for safety reasons—to provide a system capable of enabling/disabling the anchorage between the modules.

The aim of the present invention is thus to produce a magnetic module equipped with a system for enabling/disabling the magnetic force for anchoring the magnetic module to a ferromagnetic surface of another magnetic, or ferromagnetic module.

This aim is achieved by equipping a magnetic module with a system for enabling/disabling the magnetic anchoring force of the magnetic module by means of a pole inversion system of mechanical/manual or mechanical/electrical type consistent with independent claim 1, or of electromagnetic type consistent with independent claim 23.

The magnetic module with mechanical-manual or mechanical-electrical pole inversion system is characterised in that it has at least one axially extending head equipped with a system for enabling a magnetic force for anchoring said magnetic module to a ferromagnetic surface, said at least one head comprising:

a multipolar magnetic stator coaxial to the head, said magnetic stator having a magnetically enabled multipolar statoric surface for magnetic anchoring to said ferromagnetic surface, said statoric surface being formed by an arrangement of magnetically induced magnetic poles that alternately have a magnetic polarity of opposite sign;

a multipolar magnetic rotor coaxial to the multipolar magnetic stator, said magnetic rotor having a multipolar rotoric surface opposite to the multipolar statoric surface and formed by an arrangement of magnetic poles that alternately have a magnetic polarity of opposite sign; said arrangement of poles of the multipolar rotoric surface being specular to that of the multipolar statoric surface; said magnetic rotor being revolving around the axis of the head between a position that fully enables said multipolar statoric surface, in which every magnetic pole of the multipolar statoric surface is faced to a corresponding magnetic pole of identical sign of the multipolar rotoric surface so that the magnetic flux generated by the magnetic stator and magnetic rotor are added together and short-circuited through said ferromagnetic surface, and a fully-disabled position of said multipolar statoric surface, in which every magnetic pole of the multipolar statoric surface is faced to a corresponding magnetic pole of opposite sign of the multipolar rotoric surface so that the magnetic flux generated by the magnetic stator is entirely short-circuited by the magnetic rotor.

Said magnetic stator includes a number of statoric permanent magnets placed around the axis of the magnetic stator and a number of ferromagnetic sectors each interposed between a corresponding couple of statoric permanent magnets of said number of statoric permanent magnets; said statoric permanent magnets having polarisation axis oriented substantially parallel to the multipolar statoric surface, said statoric permanent magnets of each couple of statoric permanent magnets facing each to the other with a magnetic polarity of identical sign; said anchoring multipolar statoric surface being formed by the composition of a surface of each of said ferromagnetic sectors.

Said magnetic rotor includes: a number of rotoric permanent magnets placed around the axis of the magnetic rotor, said rotoric permanent magnets having polarisation axis oriented substantially orthogonal to the multipolar statoric surface, each of said rotoric permanent magnets having a magnetic polarisation opposite to that of the adjacent rotoric permanent magnet; and a ferromagnetic yoke applied for connecting the magnetic poles opposite to the magnetic stator of all said rotoric permanent magnets.

The magnetic module with electromagnetic pole inversion system is characterised in that it has at least one axially extending head equipped with a system for enabling a magnetic force for anchoring said magnetic module to a ferromagnetic surface, said at least one head comprising:

a first multipolar magnetic stator coaxial to the head, said first magnetic stator having a magnetically enabled multipolar first statoric surface for magnetic anchoring to said ferromagnetic surface, said first statoric surface being formed by an arrangement of magnetically induced magnetic poles that alternately have a magnetic polarity of opposite sign;

a second multipolar magnetic stator coaxial to the first multipolar magnetic stator, said second magnetic stator having a multipolar second statoric surface opposite to the multipolar first statoric surface and formed by an arrangement of magnetic poles that alternately have a magnetic polarity of opposite sign; said arrangement of poles of the multipolar second statoric surface being specular to that of the multipolar first statoric surface;

means for enabling/disabling the multipolar first statoric surface of the first stator by inverting the polarity of the multiple poles of the second magnetic stator, said means for enabling/disabling the multipolar first statoric surface of the first stator commuting said second multipolar statoric surface between a condition that enables said multipolar first statoric surface, in which every magnetic pole of the multipolar first statoric surface is faced to a corresponding magnetic pole of identical sign of the multipolar second statoric surface so that the magnetic flux generated by the first magnetic stator and second magnetic stator are added together and short-circuited through said ferromagnetic surface, and a disabled condition of said multipolar first statoric surface, in which every magnetic pole of the multipolar first statoric surface is faced to a corresponding magnetic pole of opposite sign of the multipolar second statoric surface so that the magnetic flux generated by the first magnetic stator is entirely short-circuited by the second magnetic stator.

Said first magnetic stator includes a number of first statoric permanent magnets placed around the axis of the first magnetic stator and a number of ferromagnetic sectors each interposed between a corresponding couple of first statoric permanent magnets of said number of first statoric permanent magnets; said first statoric permanent magnets having polarisation axis oriented substantially parallel to the multipolar first statoric surface, said first statoric permanent magnets of each couple of first statoric permanent magnets facing each to the other with a magnetic polarity of identical sign; said first anchoring multipolar statoric surface being formed by the composition of a surface of each of said ferromagnetic sectors.

Said second magnetic stator includes: a number of electromagnets placed around the axis of the second magnetic stator, said electromagnets having polarisation axis oriented substantially orthogonal to the multipolar statoric surface, each of said electromagnets having a magnetic polarisation opposite to that of the adjacent electromagnet; and a ferromagnetic yoke applied for connecting the magnetic poles opposite to the first magnetic stator of all said electromagnets.

The invention also describes an assembly of said magnetic modules, combined with each other, and possibly also with ferromagnetic modules, characterised in that the ferromagnetic anchoring surface in the assembly is provided by a ferromagnetic element integrated in the magnetic modules, or belonging to any separate ferromagnetic modules that may be included in the assembly, or by the anchoring multipolar magnetic statoric surface of the head(s) of the other magnetic modules. In this way, the head of one magnetic module can be anchored directly to the head of another magnetic module, or the head of one or more magnetic modules can be anchored to a ferromagnetic element of another magnetic module, or the head of one or more magnetic modules can be anchored to a ferromagnetic module.

At each ferromagnetic anchoring surface in the assembly, there is provided a magnetic circuit generated by the enabled head of one or more concurrent magnetic modules on the ferromagnetic anchoring surface; in said magnetic circuit the magnetic flux generated on the ferromagnetic anchoring surface by said enabled head of said one or more concurrent magnetic modules is totally or at least partially short-circuited through said head of said one or more concurrent magnetic modules on the ferromagnetic anchoring surface, and through ferromagnetic anchoring surface provided by said ferromagnetic element; in said magnetic circuit, moreover, the differences in magnetic potential produced by said enabled head of said one or more concurrent magnetic modules on the ferromagnetic anchoring surface combine, being added together in series.

Where desirable, the ferromagnetic modules can also be composed of a ferromagnetic element coated with a non-magnetic matrix, e.g. a material with a high static friction coefficient.

The system for enabling/disabling the anchorage of the magnetic module in the present invention is quick and easy, and it allows for a high ratio of the anchoring force between the modules in the assembly to the global weight of the assembly to be maintained in the enabled phase.

In the totally disabled phase, the system for enabling/disabling the anchorage of the magnetic module allows for the magnetic flux generated by the magnetic elements in the head to be completely short circuited inside the head of the magnetic module.

The present invention offers a system for enabling/disabling the one or more heads of a magnetic module that is capable of regulating the anchoring force and is also equipped with a device for preventing its accidental disabling.

It also offers the advantage that, in the case of a magnetic module with more than one head, each head can operate independently of the other.

These aspects will be clarified in the following paragraphs on preferable ways to implement the invention, described by way of example without restricting the more general principle behind the claim.

The description that follows refers to the attached drawings where:

FIGS. 1 to 4 refer to a magnetic module 1 equipped with a head 3 that can be enabled to achieve a magnetic anchorage to the ferromagnetic surface of a spherical ferromagnetic module 5.

Figure 1:
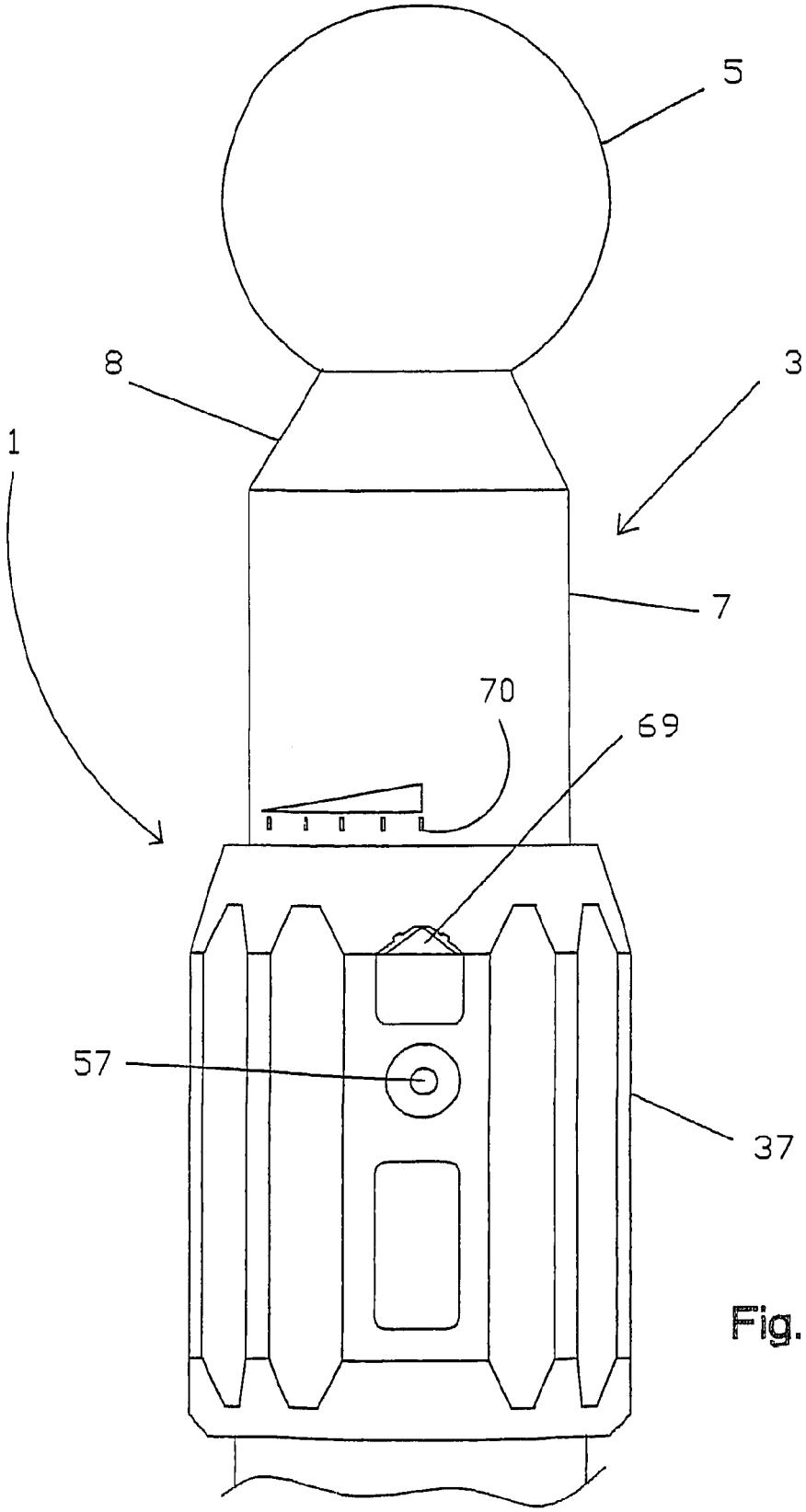
FIG. 1 shows a side view of a possible application of the head of a magnetic module consistent with the present invention anchored to a ferromagnetic module.
Figure 2:
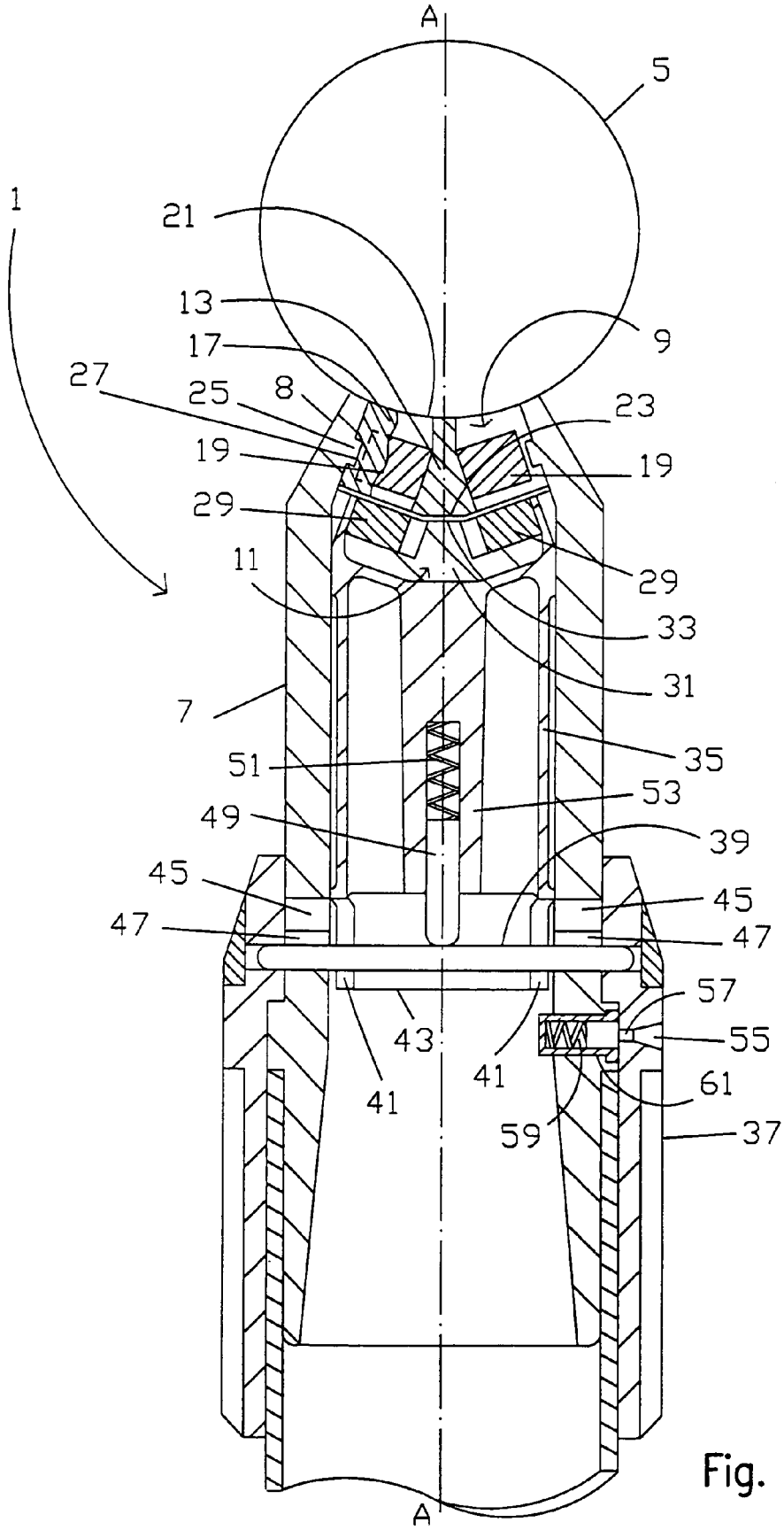
FIG. 2 is a cross-section along the axis of the head illustrated in FIG. 1.
Figure 3:
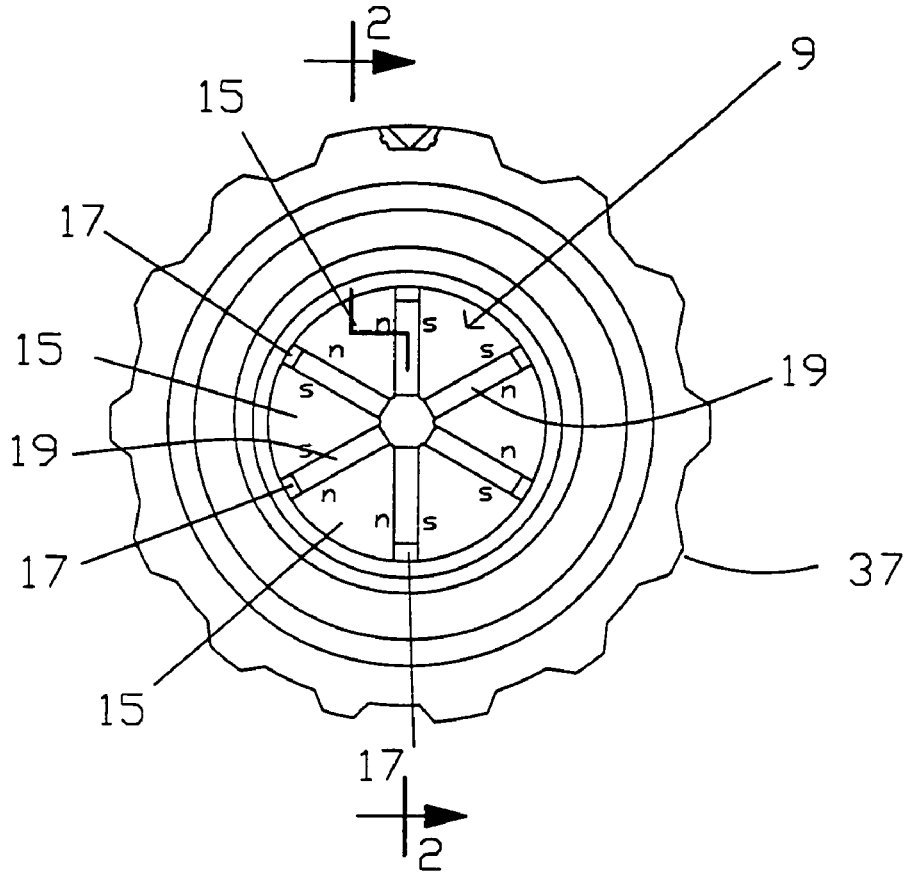
FIG. 3 is a horizontal projection of the head illustrated in FIG. 1.
Figure 4:
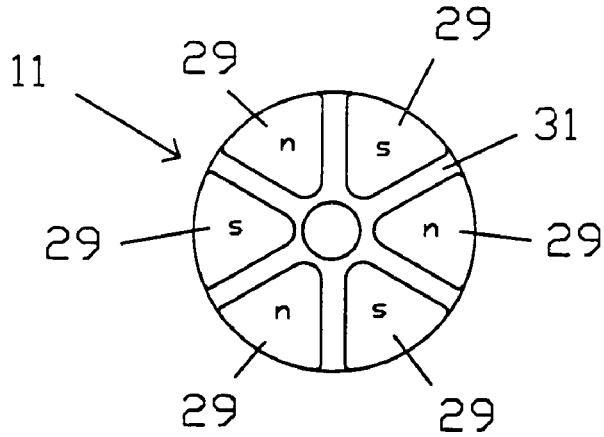
FIG. 4 is a horizontal projection of the magnetic rotor of the head in FIG. 1.

The head 3 of the module 1 extends in an axial direction, indicated by the line of dots and dashes A—A in FIG. 2, and comprises an axially hollow cylindrical ferrule 7 equipped with a tapered tip 8, a magnetic stator 9 and a magnetic rotor 11 lying opposite, coaxially and internally with respect to the ferrule 7.

The magnetic stator 9 occupies an axial position with respect to the ferrule 7, corresponding to the tip 8 of the ferrule 7, while the magnetic rotor 11 occupies a more internal axial position.

The magnetic stator 9 is composed of a main ferromagnetic element or body 13 divided radially into six identical sectors 15 by six radial grooves 17 lying at equal angles in planes passing through the axis of the head 3.

An active magnetic element, i.e. a permanent magnet 19, is attached inside each groove 17 in the main ferromagnetic body 13 of the magnetic stator 9. The permanent magnets 19 are identical and are arranged with their magnetic polarisation axis substantially parallel to the head surface 21 of the magnetic stator, while each pair of adjacent permanent magnets 19 presents a magnetic polarity of the same sign towards the ferromagnetic sector 15 it defines. The six sectors 15 of the main ferromagnetic body 13 of the magnetic stator 9 form an anchoring multipolar statoric surface 21 magnetically induced by the active magnetic elements 19 with an alternately positive and negative magnetic polarity.

The main ferromagnetic body 13 of the magnetic stator 9 may be in a single piece, as described above, or it may also be divided into completely separate sectors arranged around an angle of 360° and laterally spaced from each other in such a way as to define seats for housing the permanent magnets of the magnetic stator 9.

The multipolar head surface 21 of the main ferromagnetic body 13 of the magnetic stator 9 is aligned at the tip 8 of the ferrule 7 and composed of six polar areas with a 60° angle of aperture and a specular multipolar base surface 23.

The magnetic stator 9 can be fixed to the ferrule 7 by means of a mechanical keying between projections 25 on the ferrule 7 and corresponding recesses 27 in the magnetic stator body 9.

The magnetic rotor 11 of the head 3 comprises six identical active magnetic elements, i.e. six permanent magnets 29, and a ferromagnetic element or yoke 31 for connecting and supporting the permanent magnets 29 positioned, with respect to the permanent magnets 29, on the side opposite the magnetic stator 9.

The six permanent magnets 29 of the magnetic rotor 11 have a polarisation axis orthogonal to the statoric multipolar surface 21.

The six permanent magnets 29 of the magnetic rotor 11 are arranged at equal angles around the axis of the head 3 and with an alternating polarity so as to generate a multipolar rotoric surface 33 specular to the anchoring multipolar statoric surface 21.

The sizing of the magnetic and ferromagnetic components of the magnetic stator 9 and of the magnetic rotor 11 must be such that, when the head 3 is disabled, when every pole of the multipolar statoric surface 21 is magnetically in series with a corresponding pole of the multipolar rotoric surface 33, the magnetic rotor 11 can completely absorb the magnetic flux generated by the magnetic stator 9, short circuiting said flux completely through the ferromagnetic yoke 31 so as to leave the multipolar statoric surface 21 of the magnetic stator 9 disabled for the purposes of the anchorage of the magnetic module 1 to the ferromagnetic surface of module 5.

The ferromagnetic module 5 is hollow and its thickness must be kept to a minimum in order to increase the ratio of the magnetic anchoring force between the two modules to the weight of the two modules, nonetheless taking into account that the thickness of the ferromagnetic module 5 cannot drop below a certain value in order to guarantee the total short circuiting of the magnetic flux generated by the head 3. However, for a given extension of the multipolar statoric surface 21, a complete short circuit of the magnetic flux can be maintained by compensating for any reduction in the thickness of the ferromagnetic module 5 with an increase in the number of pairs of poles in the magnetic stator 9.

In a possible variant of the present invention, the part of the magnetic rotor corresponding to the permanent magnets 29 and the yoke 31 that connects them can be replaced by a body having the same structure as the magnetic stator 9, i.e. a main ferromagnetic body containing a set of active magnetic elements placed exactly as in the magnetic stator 9. In this case, the multipolar rotoric surface 33 is induced by the active magnetic elements of the magnetic rotor.

The magnetic rotor 11 comprises a bell 35 for guiding the rotation of the magnetic rotor 11, coaxial and internal with respect to the ferrule 7 and solidly extending to the yoke 31 for supporting the permanent magnets 29 of the magnetic rotor 11 from the yoke 31 side opposite the permanent magnets 29.

To guide the rotation of the magnetic rotor 11, the bell 35 for guiding the magnetic rotor 11 is itself guided by the inside wall of the ferrule 7.

The multipolar rotoric surface 33 and the base surface 23 of the magnetic stator 9 are each equipped with high-strength steel friction plates designed to facilitate the relative rotation between the magnetic stator 9 and the magnetic rotor 11, while offering a minimum resistance to the passage of the magnetic flux from one side to the other.

The head 3 of the magnetic module 1 comprises a cylindrical ring 37 keyed coaxially and externally to the ferrule 7 so that it can turn and slide with respect to the axis of the ferrule 7 to mechanically/manually drive the rotation of the magnetic rotor 11.

For the transmission of the rotation of the ring 37 to the magnetic rotor 11, the ring 37 diametrically supports a drive rod 39 fitted in a pair of diametrically-aligned slots 41 cut in the edge 43 at the end of the bell 35 situated axially opposite the magnetic stator 9.

The slots 41 are axially elongated so as to keep the drive rod 39 engaged but free to slide in the axial direction of the ferrule 7.

The drive rod 39 is placed across two slits 45 cut along two diametrically-opposite stretches of the circumference of the ferrule 7.

The slits 45 in the ferrule 7 also have openings in the axial direction of the ferrule 7 so as to allow for the displacement of the rod 39 and of the connected ring 37 in the axial direction of the ferrule 7.

The lip of each slit 45 in the ferrule 7 axially furthest away from the tip 8 of the ferrule 7 is shaped into a series of notches 47 cut at angular intervals diametrically opposite the notches 47 on the opposite slit.

The drive rod 39 is pressed against this lip on the slits 45 of the ferrule 7 by a stud 49, that is axially movable in a hub 53 on the guide bell 35, coaxial to the head 3 and elastically loaded by a helical spring 51 placed between the stud 49 and a shoulder inside the hub 53.

The rotation of the ring 37 can therefore be locked in steps each time the drive rod 39 snaps up against a pair of opposite notches 47 in the slits 45 of the ferrule 7. Each step in the rotation of the ring 37 corresponds to an enabling level of the head 3.

To adjust the enabling level of the head 3, the ring 37 is turned manually until an indicator arrow 69 provided on the outer surface of the ring 37 comes into line with the required enabling level 70, selected from a number of possible levels etched on the outer surface of the ferrule 7.

In the fully enabled condition of the head 3, the poles of the multipolar statoric surface 21 are faced to the poles of the same sign of the multipolar rotoric surface 33 of the magnetic rotor 11. The magnetic flux generated by the magnetic stator 9 is added to the flux generated by the magnetic rotor 11 and short-circuited through the ferromagnetic ball 5.

In the fully disabled condition of the head 3, obtained by turning the magnetic rotor 11 through 60°, the poles of the multipolar statoric surface 21 are faced to the poles of the opposite sign of the multipolar rotoric surface 33. The entire magnetic flux generated by the magnetic stator 9 is short-circuited by the magnetic rotor 11 and the differences in magnetic potential installed in the magnetic stator 9 are added in series to those of the magnetic rotor 11 through the ferromagnetic yoke 31.

In the respective angular positions between the magnetic stator 9 and the magnetic rotor 11 that go from the fully-disabled to the fully-enabled position of the head 3, a progressively increasing proportion of the flux generated by the magnetic stator 9 and by the magnetic rotor 11 is short-circuited through the ferromagnetic ball 5 so the force of anchorage between the magnetic module 1 and the ferromagnetic module 5 also increase progressively.

The head 3 of the module 1 can also have a different system for driving the rotation of the magnetic rotor 11, e.g. of electrical/mechanical type. This system comprises a hole in the ferrule and a gear ring attached coaxially and solidly to the bell of the magnetic rotor. The rotation of the rotor can be governed with the aid of an electric screwdriver with a pinion-shaped bit capable of engaging the gear ring through the hole in the ferrule.

The magnetic module 1 also comprises a safety device that prevents any accidental disabling of the head 3.

The safety device comprises a hole 55 in the ring 37 and a pawl 57 with a spring 59 that can be aligned with the hole 55 in the ring 37 in line with the position of the magnetic rotor 11 in which the head 3 is fully enabled.

The pawl 57 fits into a small cylinder 61 which is attached through the ferrule 7 and can extend due to the effect of the spring 59 into the hole 55 in the ring 37 in order to block the rotation of the ring 37. To disable or adjust the head 3 starting from the fully-enabled position simply requires the use of a pointed tool inserted in the hole 55 in the ring 37 in order to make the pawl 57 return inside its container cylinder 61, against the force of the spring 59.

Without departing from the context of the present invention, a magnetic module head can also be enabled by means of an electromagnetic system for inducing the polar inversion of the head. This simply involves replacing the previously-described magnetic rotor with a second magnetic stator identical to the above described magnetic rotor except for the fact that the permanent magnets of the second magnetic stator must have a globally lower coercivity than the permanent magnets of the first stator and must each be surrounded by a corresponding inversion solenoid. A current produced by a suitable d.c. generator is made to circulate in each solenoid in one direction or the other in order to invert the polarity of the corresponding permanent magnet. In this case, the force of anchorage is adjusted by means of current discharges of variable intensity and the safety of the head is intrinsic in that the head is only disabled by a discharge opposite to the head-enabling discharge.

Figure 5:
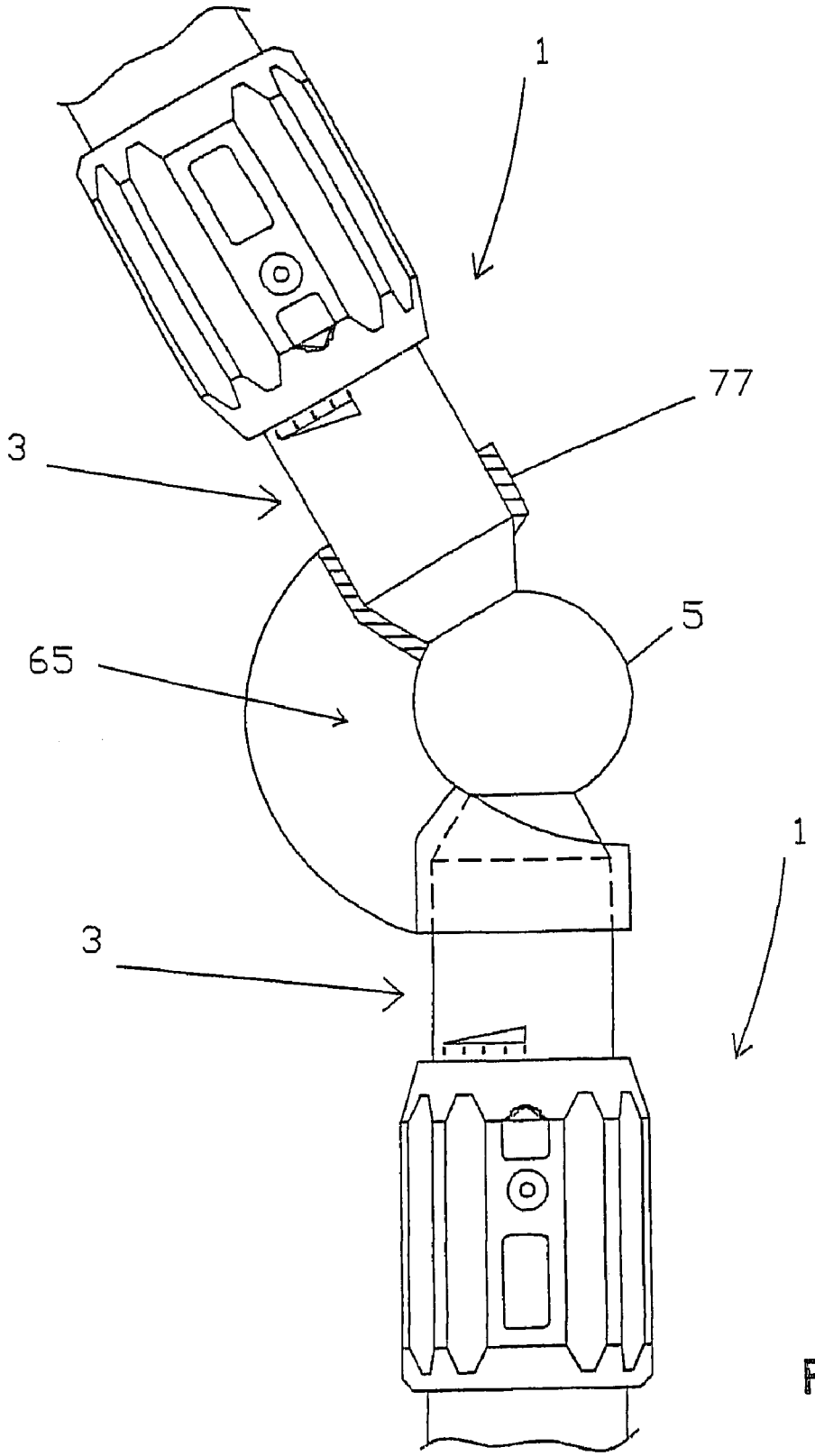
FIG. 5 is a side view of an assembly of modules consistent with the present invention combined with the aid of a stiffening device.

FIG. 5 illustrates a set of magnetic anchoring modules comprising two magnetic modules 1 anchored to a ferromagnetic module 5. If necessary, the structure can be stiffened by an angular stiffening element 65 complete with tubes 77 for coupling to the magnetic modules 1 of a type consistent with the one described in the patent application M12001A000608, which is the property of the present applicant.

When both the heads 3 of the magnetic modules 1 are enabled, a magnetic flux circulates between the two heads 3 through the ferromagnetic ball 5; in this magnetic circuit, the differences in magnetic potential installed in the magnetic stator and rotor of each head 3 are magnetically added in series to those in the magnetic stator and rotor of the other head 3.

In general, therefore, each time an enabled head 3 of an additional magnetic module 1 is attached to the ferromagnetic module 5, there is an increase in the force anchoring the magnetic module 1 to the ferromagnetic module 5.

The module 1 can also act as a system for coupling to a stiffening element of the type described in the patent application M12001A000608 capable of attaching the magnetic module 1 solidly to the stiffening element 65 when the magnetic module 1 is subject to a tensile stress superior to the force of magnetic attraction exerted by the magnetic module 1 in question. Said coupling system can be provided on all the magnetic modules or only on the specific magnetic modules subject to tensile stresses beyond the force of magnetic attraction that they are capable of generating.

Figure 8:
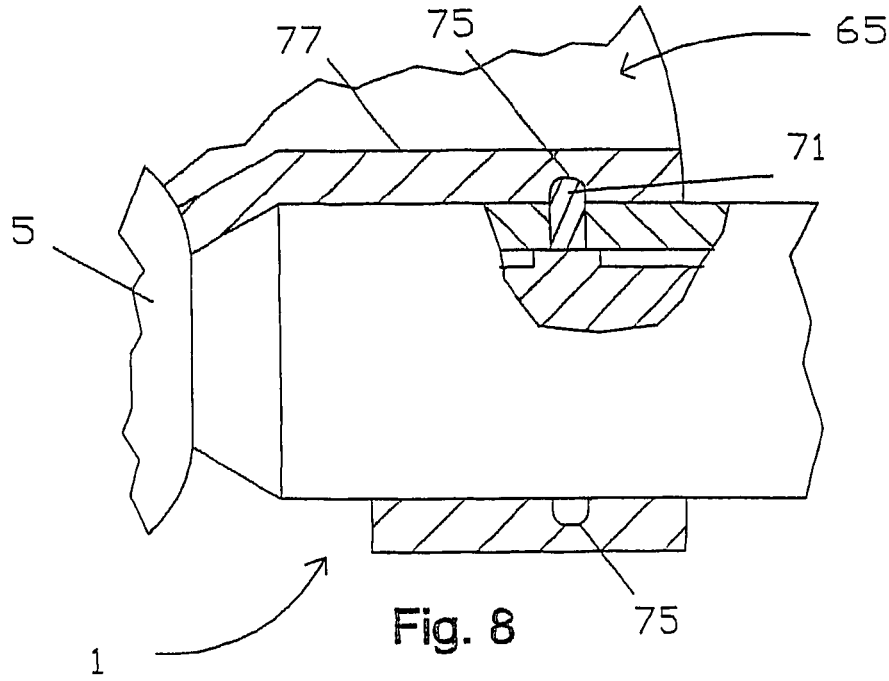
FIG. 8 is a side view with a partial cross-section of a magnetic module consistent with the present invention equipped with means for locking the magnetic module under tensile stress against a stiffening element in which the magnetic module is inserted.
Figure 9:
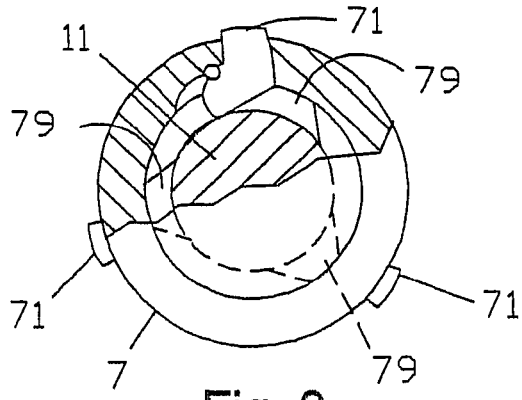
FIG. 9 is a front view with a partial cross-section of FIG. 8, with the magnetic rotor in the position in which the head is completely enabled.
Figure 10:
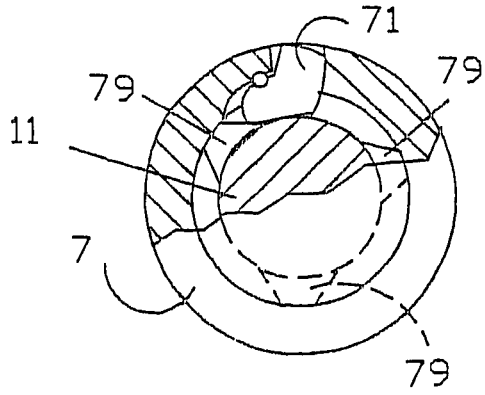
FIG. 10 is a front view with a partial cross-section of FIG. 8, with the magnetic rotor in the position in which the head is disabled.

Such a coupling system, according to a possible implementation illustrated in FIGS. 8–10, is composed of a set of pins 71, three in this case, hinged to the circumference of the ferrule 7 and projecting radially through the thickness of the ferrule 7 so as to come up against a corresponding recess 75 in the coupling tubes 77 of the stiffening element 65 in line with the enabled condition of the head in the magnetic module 1.

The three pins 71 lie at an angular distance of 120°; they can be turned in the plane orthogonal to the axis of the ferrule 7 and they can be extended or withdrawn by sliding on corresponding cams 79 set in the outer circumference of the bell 35 that is solidly attached to the rotor 11. On placing the rotor 11 in the position coinciding with the fully-disabled condition of the head of the magnetic module 1, each pin 71 abandons its corresponding cam 79 and withdraws inside the ferrule 7, thus enabling the magnetic module 1 to slide out of the stiffening element 65.

Figure 6:
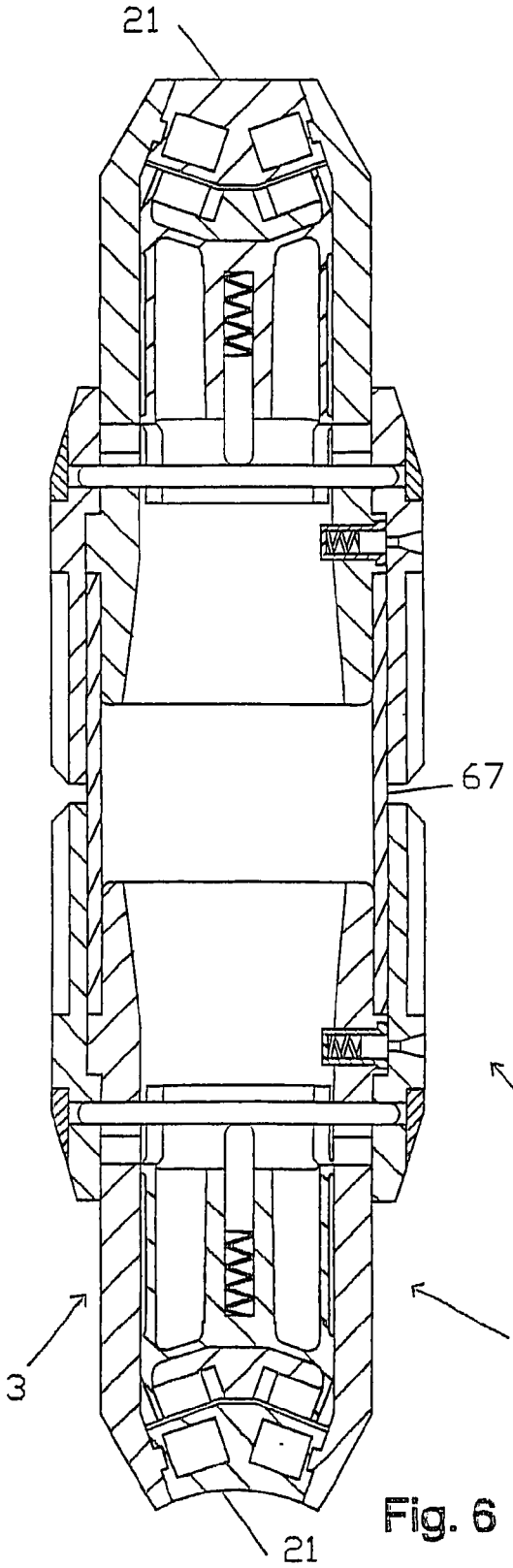
FIG. 6 is a side view of a magnetic module consistent with the present invention cut through its axis.

FIG. 6 shows a module 1' with two coaxial heads 3 that can be enabled independently of each other. The two heads 3 are keyed to the ends of a cylindrical connection tube 67, which could be made, for instance, of plastic or carbon fibre or aluminium.

Again in FIG. 6, the magnetic stator of one of the heads 3 has a flat multipolar head surface 21 suitable for anchoring to a flat ferromagnetic surface on a magnetic or ferromagnetic module, while the magnetic stator of the other head 3 has an arched multipolar head surface 21 suitable for anchoring to a spherical magnetic or ferromagnetic module.

Of course, the shape of the multipolar head surface of the magnetic stator can be varied at will to suit the shape of the surface to anchor, and can also be varied at will in a given magnetic module comprising more than one anchoring head 3.

Figure 7:
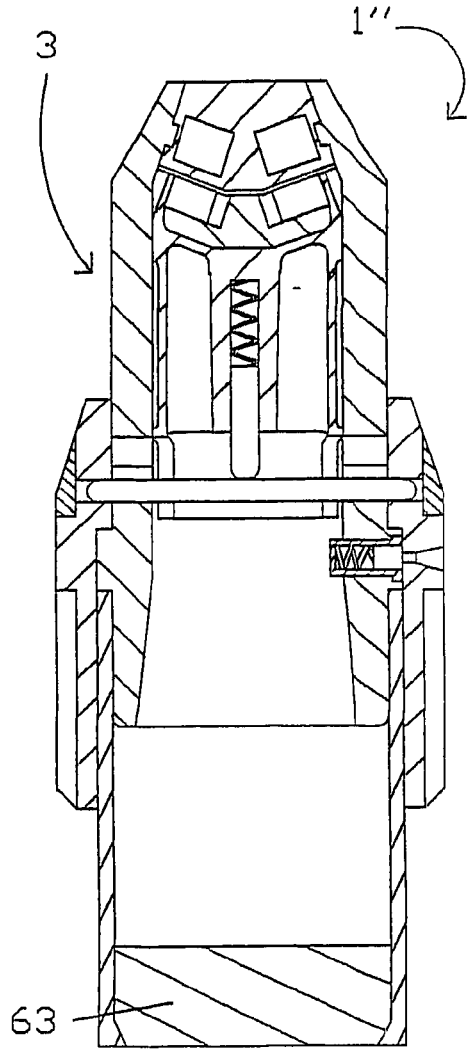
FIG. 7 is a side view of a further magnetic module consistent with the present invention cut through its axis.

FIG. 7 shows a structure with a magnetic module 1" that allows for the anchorage of another magnetic module.

The magnetic module 1" has only one head 3 to enable, but is equipped with a ferromagnetic element 63 at the axially opposite end to said head 3.

In this case, the outer surface of the ferromagnetic element 63 of the magnetic module 1" can be anchored by an enabled head of another magnetic module.

Of course, the invention extends to the case of anchoring the head of a magnetic module to a ferromagnetic surface even without direct contact, with a non-ferromagnetic material between them. This may be the case, for instance, if the spherical ferromagnetic module of FIG. 5 were coated with a non-magnetic matrix with a high friction coefficient.

In the assembly of lattice structures consistent with the present invention, it is sometimes necessary to close the structure by adding a final module between modules with a fixed distance between centres, e.g. an elongated magnetic module between two spherical ferromagnetic modules already in position with a fixed distance between them.

To facilitate said operation, especially when the modules in the structure are connected by means of stiffening elements, the connection tube on the heads of a magnetic module of the present invention, e.g. the cylindrical tube indicated by 67 in FIG. 6, can be equipped with a telescoping connection system between the heads.

By way of example, the connection tube 67 of FIG. 6 could be divided into two parts, each solidly attached to one head of the magnetic module and a central body with a telescoping movement and a longitudinal bayonet coupling could be inserted between these two separate parts. The heads of the magnetic module could thus be brought closer together to insert the magnetic module in the lattice structure, then spread further apart for its final positioning, turning the tube in order to trip the bayonet coupling. This solution can be provided as necessary on one, several or all of the magnetic modules.

What is claimed is:

1. Magnetic module (1) characterised in that it has at least one axially extending head (3) equipped with a system for enabling a magnetic force for anchoring said magnetic module (1) to a ferromagnetic surface, said at least one head (3) comprising:—a multipolar magnetic stator (9) coaxial to the head (3), said magnetic stator (9) having a magnetically enabled multipolar statoric surface (21) for magnetic anchoring to said ferromagnetic surface, said statoric surface (21) being formed by an arrangement of magnetically induced magnetic poles that alternately have a magnetic polarity of opposite sign; —a multipolar magnetic rotor (11) coaxial to the multipolar magnetic stator (9), said magnetic rotor (11) having a multipolar rotoric surface (33) opposite to the multipolar statoric surface (21) and formed by an arrangement of magnetic poles that alternately have a magnetic polarity of opposite sign; said arrangement of poles of the multipolar rotoric surface (33) being specular to that of the multipolar statoric surface (21); said magnetic rotor (11) being revolving around the axis of the head (3) between a position that fully enables said multipolar statoric surface (21), in which every magnetic pole of the multipolar statoric surface (21) is faced to a corresponding magnetic pole of identical sign of the multipolar rotoric surface (33) so that the magnetic flux generated by the magnetic stator (9) and magnetic rotor (11) are added together and short-circuited through said ferromagnetic surface, and a fully-disabled position of said multipolar statoric surface (21), in which every magnetic pole of the multipolar statoric surface (21) is faced to a corresponding magnetic pole of opposite sign of the multipolar rotoric surface (33) so that the magnetic flux generated by the magnetic stator (9) is entirely short-circuited by the magnetic rotor (11).

2. A magnetic module according to claim 1, characterised in that, to adjust the force of magnetic anchorage of the head (3), the relative angular position of the magnetic rotor (11) of the head (3) can be adjusted with respect to the magnetic stator (9) of the head (3) in any intermediate position between the fully-enabled position and the fully-disabled position of said multipolar statoric surface (21).

3. A magnetic module according to claim 1, characterised in that said magnetic stator (9) includes a number of statoric permanent magnets (19) placed around the axis of the magnetic stator (9) and a number of ferromagnetic sectors (15) each interposed between a corresponding couple of statoric permanent magnets (19) of said number of statoric permanent magnets (19); said statoric permanent magnets (19) having polarisation axis oriented substantially parallel to the multipolar statoric surface (21), said statoric permanent magnets (19) of each couple of statoric permanent magnets (19) facing each to the other with a magnetic polarity of identical sign; said anchoring multipolar statoric surface (21) being formed by the composition of a surface of each of said ferromagnetic sectors (15).

4. A magnetic module according to claim 1, characterised in that said magnetic rotor (11) includes: a number of rotoric permanent magnets (29) placed around the axis of the magnetic rotor (11), said rotoric permanent magnets (29) having polarisation axis oriented substantially orthogonal to the multipolar statoric surface (21), each of said rotoric permanent magnets (29) having a magnetic polarisation opposite to that of the adjacent rotoric permanent magnet (29); and a ferromagnetic yoke (31) applied for connecting the magnetic poles opposite to the magnetic stator (9) of all said rotoric permanent magnets (29).

5. A magnetic module according to claim 1, characterised in that said magnetic rotor is structurally identical to said magnetic stator (9).

6. A magnetic module according to claim 1, characterised in that and a high-strength steel friction plate is provided between the magnetic stator (9) and the magnetic rotor (11).

7. A magnetic module according to claim 1, characterised in that, to contain the magnetic stator (9) and the magnetic rotor (11) of the head (3), each head (3) includes a hollow ferrule (7) coaxial to the head (3) and defining a cylindrical inside wall.

8. A magnetic module according to claim 7, characterised in that the magnetic rotor (11) of each head (3) also comprises, on the side of the magnetic rotor (11) opposite the magnetic stator (9), a cylindrical guide bell (35) coaxial to the ferrule (7) and guided by the cylindrical inside wall of the ferrule (7) in its rotation around the axis of the head (3).

9. A magnetic module according to claim 8, characterised in that said at least one head (3) has a mechanical/manual drive system for turning the magnetic rotor (11).

10. A magnetic module according to claim 9, characterised in that said mechanical/manual drive system for turning the magnetic rotor (11) comprises a cylindrical ring (37) keyed axially and externally to the ferrule (7) so that it can rotate and slide with respect to the axis of the ferrule (7), and means for transmitting the rotation of the ring (37) to the magnetic rotor (11).

11. A magnetic module according to claim 10, characterised in that said means for transmitting the rotation of the ring (37) to the magnetic rotor (11) comprise a pair of diametrically-aligned slots (41) cut in the edge (43) of the end of the bell (35) axially opposite the magnetic stator (9) and lying parallel to the axis of the head (3), and a rod (39) attached along a diameter of the ring (37) and inserted so that it can slide in the direction of the head's axis within said pair of slots (41) in the bell (35) of the magnetic rotor (11).

12. A magnetic module according to claim 11, characterised in that, along two diametrically-opposite stretches of the circumference of the ferrule (7), there are two slits (45) cut diametrically opposite each other through which the rod

(39) for driving the rotation of the ring (37) is connected to the bell (35) of the magnetic rotor (11), said two slits (45) in the ferrule (7) opening in the axial direction of the ferrule (7) so as to allow also for a displacement of the ring (37) in relation to the ferrule (7) in the direction of the head's axis.

13. A magnetic module according to claim 12, characterised in that means are provided for blocking the rotation of the ring (37) in successive steps.

14. A magnetic module according to claim 13, characterised in that said means for blocking the rotation of the ring (37) in steps are in the form of a set of diametrically-opposite pairs of locator notches (47) placed at angular intervals inside said two slits (45) in the ferrule (7) for holding the drive rod (39) that turns the ring (37).

15. A magnetic module according to claim 14, characterised in that said bell (35) has a central hub (53) coaxial to the head (3) and open towards the axial end of the bell (35) opposite the magnetic stator (9), and a stud (49) that slides inside said hub (53) in the bell (35) and that is elastically pressed against the drive rod (39) for turning the ring (37) in order to snap block/release said drive rod (39) in a given pair of locator notches (47).

16. A magnetic module according to claim 15, characterised in that a safety device is provided to prevent any accidental disabling of the multipolar magnetic anchoring surface (21) of the magnetic stator (9).

17. A magnetic module according to claim 16, characterised in that said safety device includes a hole (55) in the ring (37) and a sprung pawl (57) supported so that it can slide through the ferrule (7) in the direction orthogonal to the axis of the head (3); said sprung pawl (57) can be located in the hole (55) in the ring (37) to block the rotation of the ring (37) in line with the fully-enabled state of the multipolar magnetic anchoring surface (21) of the magnetic stator (9).

18. A magnetic module according to claim 7, in which said magnetic module (1) is connected to at least one other magnetic (1) and/or ferromagnetic module by means of a stiffening element (65), characterised in that said magnetic module (1) and said stiffening element (65) have means for coupling with each other against a tensile stress on the magnetic module (1) exceeding the force of magnetic attraction exerted by the magnetic module (1).

19. A magnetic module according to claim 18, characterised in that said coupling means include a set of radially-arranged pins (71) that can extend from the ferrule (7) of said at least one magnetic head (3) of the magnetic module (1) and a set of recesses (75) in the stiffening element (65), each of said recesses (75) being suitable for containing a corresponding pin (71) of said set of pins (71) extending from the ferrule (7).

20. A magnetic module according to claim 19, characterised in that the radially outer surface of said magnetic rotor (11) is shaped with a set of cams (79), each cam (79) in said set of cams (79) being suitable for engaging with a corresponding pin (71) in said set of pins (71) in order to make the corresponding pins (71) extend outside the ferrule (7) in line with the fully-enabled working condition of said at least one head (3), and for disengaging from the corresponding pin (71) to withdraw said pin (71) inside the ferrule (7) in line with the fully-disabled working condition of said at least one magnetic head (3).

21. A magnetic module according to claim 8, characterised in that said at least one head (3) has an electrical/mechanical drive system for turning the magnetic rotor (11).

22. A magnetic module according to claim 21, characterised in that said electrical/mechanical drive system for turning the magnetic rotor (11) comprises a hole in the ferrule (7), a gear ring placed coaxially to the bell of the magnetic rotor (11) and an electric screwdriver with a pinion-shaped bit capable of engaging said gear wheel through said hole in the ferrule (7).

23. Magnetic module characterised in that it has at least one axially extending head equipped with a system for enabling a magnetic force for anchoring said magnetic module to a ferromagnetic surface, said at least one head comprising:

a first multipolar magnetic stator coaxial to the head, said first magnetic stator having a magnetically enabled multipolar first statoric surface for magnetic anchoring to said ferromagnetic surface, said first statoric surface being formed by an arrangement of magnetically induced magnetic poles that alternately have a magnetic polarity of opposite sign;

a second multipolar magnetic stator coaxial to the first multipolar magnetic stator, said second magnetic stator having a multipolar second statoric surface opposite to the multipolar first statoric surface and formed by an arrangement of magnetic poles that alternately have a magnetic polarity of opposite sign; said arrangement of poles of the multipolar second statoric surface being specular to that of the multipolar first statoric surface;

means for enabling/disabling the multipolar first statoric surface of the first stator by inverting the polarity of the multiple poles of the second magnetic stator, said means for enabling/disabling the multipolar first statoric surface of the first stator commuting said second multipolar statoric surface between a condition that enables said multipolar first statoric surface, in which every magnetic pole of the multipolar first statoric surface is faced to a corresponding magnetic pole of identical sign of the multipolar second statoric surface so that the magnetic flux generated by the first magnetic stator and second magnetic stator are added together and short-circuited through said ferromagnetic surface, and a disabled condition of said multipolar first statoric surface, in which every magnetic pole of the multipolar first statoric surface is faced to a corresponding magnetic pole of opposite sign of the multipolar second statoric surface so that the magnetic flux generated by the first magnetic stator is entirely short-circuited by the second magnetic stator.

24. A magnetic module according to claim 23, characterised in that said first magnetic stator includes a number of first statoric permanent magnets placed around the axis of the first magnetic stator and a number of ferromagnetic sectors each interposed between a corresponding couple of first statoric permanent magnets of said number of first statoric permanent magnets; said first statoric permanent magnets having polarisation axis oriented substantially parallel to the multipolar first statoric surface, said first statoric permanent magnets of each couple of first statoric permanent magnets facing each to the other with a magnetic polarity of identical sign; said anchoring multipolar first statoric surface being formed by the composition of a surface of each of said ferromagnetic sectors.

25. A magnetic module according to claim 24, characterised in that said second magnetic stator includes: a number of electromagnets placed around the axis of the second magnetic stator, said electromagnets having polarisation axis oriented substantially orthogonal to the multipolar statoric surface, each of said electromagnets having a magnetic polarisation opposite to that of the adjacent electromagnet; and a ferromagnetic yoke applied for connecting the magnetic poles opposite to the first magnetic stator of all said electromagnets.

26. A magnetic module according to claim 25, characterised in that, to adjust the magnetic anchoring force of the magnetic module, electrical discharges of variable intensity are fed into the elecromagnets.

27. A magnetic module according to claim 23, characterised in that it includes a telescoping system for reducing its axial length.

28. A magnetic module according to claim 27, characterised in that it includes a bayonet coupling for said telescoping system for reducing the axial length of the magnetic module.

29. An assembly comprising magnetic modules (1,1', 1") consistent with claim 1, combined together and possibly also with ferromagnetic modules, characterised in that said ferromagnetic surface in the assembly is provided by a ferromagnetic element integrated in the magnetic modules, or forming a part of separate ferromagnetic modules that may be included in the assembly, of by multipolar magnetic anchoring surface of said at least one head of other magnetic modules.

30. An assembly of magnetic modules (1,1', 1") consistent with claim 29, characterised in that, at each ferromagnetic anchoring surface of the assembly, magnetic circuits are generated by the enabled head of one or more concurrent magnetic modules on the ferromagnetic anchoring surface; in this magnetic circuit, the magnetic flux generated by said enabled head of said one or more concurrent magnetic modules on the ferromagnetic anchoring surface is totally or at least partially short-circuited through said head of the said one or more concurrent magnetic modules on the ferromagnetic anchoring surface and through said ferromagnetic element constituting the ferromagnetic anchoring surface; in this magnetic circuit, moreover, the differences in magnetic potential generated by said enabled head of said one or more concurrent magnetic modules on the ferromagnetic anchoring surface are added together in series.

* * * * *